US009494155B2

(12) United States Patent
Iitsuka et al.

(10) Patent No.: US 9,494,155 B2
(45) Date of Patent: Nov. 15, 2016

(54) SCROLL COMPRESSION DEVICE

(75) Inventors: Satoshi Iitsuka, Gunma-ken (JP); Tsutomu Kon, Gunma-ken (JP); (Continued)

(73) Assignee: PANASONIC INTELLECTUAL PROPERTY MANAGEMENT CO., LTD., Osaka-shi (JP)

( * ) Notice: Subject to any disclaimer, the term of this patent is extended or adjusted under 35 U.S.C. 154(b) by 460 days.

(21) Appl. No.: 14/007,181

(22) PCT Filed: Dec. 20, 2011

(86) PCT No.: PCT/JP2011/079469
§ 371 (c)(1),
(2), (4) Date: Oct. 17, 2013

(87) PCT Pub. No.: WO2012/127755
PCT Pub. Date: Sep. 27, 2012

(65) Prior Publication Data

US 2014/0037474 A1 Feb. 6, 2014

(30) Foreign Application Priority Data

Mar. 24, 2011 (JP) ..... 2011-065607
Mar. 25, 2011 (JP) ..... 2011-066920
(Continued)

(51) Int. Cl.
*F04C 23/02* (2006.01)
*F04C 18/02* (2006.01)
(Continued)

(52) U.S. Cl.
CPC ..... *F04C 23/02* (2013.01); *F04C 2/025* (2013.01); *F04C 18/0215* (2013.01);
(Continued)

(58) Field of Classification Search
CPC ..... F04C 23/02; F04C 23/008; F04C 18/0215; F04C 29/028; F04C 2/025;
(Continued)

(56) References Cited

U.S. PATENT DOCUMENTS 4,496,293 A 1/1985 Nakamura et al.
2004/0040323 A1 3/2004 Yokozeki et al.
(Continued)

FOREIGN PATENT DOCUMENTS

CN 1480695 A 3/2004
CN 1550669 A 12/2004
(Continued)

OTHER PUBLICATIONS

English Translation of the International Preliminary Report on Patentability of PCT/JP2011/079469 mailing date Oct. 3, 2013 with forms PCT/IB/338, PCT/IB/373 and PCT/IB/237 (7 pages).
(Continued)

*Primary Examiner* — Devon Kramer
*Assistant Examiner* — Lilya Pekarskaya
(74) *Attorney, Agent, or Firm* — Westerman, Hattori, Daniels & Adrian, LLP

(57) ABSTRACT

A scroll compression device that prevents scattering of lubrication oil to a discharge pipe side is provided. A cup 48 which is opened at the lower portion thereof and prevents scattering of lubrication oil is disposed on the lower surface of the main frame 21, and an annular insulator 19 having a double wall structure which surrounds windings is disposed on the upper surface of a stator 37. The peripheral wall of the cup 48 is hung between the double walls 19A, 19B of the insulator.

9 Claims, 3 Drawing Sheets

(75) Inventors: Akihiro Hayashi, Gunma-ken (JP); Yasunori Kiyokawa, Gunma-ken (JP); Kazuyoshi Sugimoto, Gunma-ken (JP); Yoshihiko Nagase, Gunma-ken (JP); Katsuki Akuzawa, Gunma-ken (JP); Kenji Aida, Gunma-ken (JP); Yoshiaki Nagasawa, Gunma-ken (JP)

(30) Foreign Application Priority Data

| | | |
|---|---|---|
| Mar. 25, 2011 | (JP) | 2011-066921 |
| Mar. 25, 2011 | (JP) | 2011-067051 |
| Mar. 28, 2011 | (JP) | 2011-069123 |
| Mar. 29, 2011 | (JP) | 2011-071324 |
| Mar. 29, 2011 | (JP) | 2011-071495 |

(51) Int. Cl.
*F04C 23/00* (2006.01)
*F04C 29/02* (2006.01)
*F04C 2/02* (2006.01)

(52) U.S. Cl.
CPC ..... *F04C 23/008* (2013.01); *F04C 29/02* (2013.01); *F04C 29/028* (2013.01); *F04C 2240/40* (2013.01); *F04C 2240/56* (2013.01); *F04C 2240/60* (2013.01)

(58) Field of Classification Search
CPC ..... Y10T 29/49359; Y10T 29/49316; Y10T 29/37; B23P 11/00
See application file for complete search history.

(56) References Cited

U.S. PATENT DOCUMENTS

| | | | | |
|---|---|---|---|---|
| 2004/0197213 | A1* | 10/2004 | Takemoto | 417/410.1 |
| 2005/0086960 | A1 | 4/2005 | Yokozeki et al. | |
| 2005/0210663 | A1 | 9/2005 | Ishida et al. | |
| 2005/0220652 | A1 | 10/2005 | Yamaji et al. | |
| 2006/0099086 | A1 | 5/2006 | Morozumi et al. | |
| 2008/0175738 | A1* | 7/2008 | Jung | F04C 18/0215 418/55.6 |
| 2008/0298986 | A1 | 12/2008 | Ishida et al. | |
| 2011/0285240 | A1* | 11/2011 | Tsukamoto et al. | 310/215 |
| 2012/0007455 | A1 | 1/2012 | Tanaka | |

FOREIGN PATENT DOCUMENTS

| | | | |
|---|---|---|---|
| CN | 1638241 | A | 7/2005 |
| CN | 1698249 | A | 11/2005 |
| CN | 101145716 | A | 3/2008 |
| EP | 1956244 | A2 | 8/2008 |
| EP | 2416013 | A1 | 2/2012 |
| JP | 55-46081 | A | 3/1980 |
| JP | 57-212389 | A | 12/1982 |
| JP | 58-165907 | A | 10/1983 |
| JP | 59-29785 | A | 2/1984 |
| JP | 60-075795 | A | 4/1985 |
| JP | 60-206998 | A | 10/1985 |
| JP | 61-167354 | A | 7/1986 |
| JP | 05-312157 | A | 11/1993 |
| JP | 11-132164 | A | 5/1999 |
| JP | 11-275824 | A | 10/1999 |
| JP | 11-341752 | A | 12/1999 |
| JP | 2000-161268 | A | 6/2000 |
| JP | 2001-41184 | A | 2/2001 |
| JP | 2002-199670 | A | 7/2002 |
| JP | 2003-35289 | A | 2/2003 |
| JP | 2003-230260 | A | 8/2003 |
| JP | 2004-011473 | A | 1/2004 |
| JP | 2004-060532 | A | 2/2004 |
| JP | 2004-251173 | A | 9/2004 |
| JP | 2004-293492 | A | 10/2004 |
| JP | 2005-188519 | A | 7/2005 |
| JP | 2006-132419 | A | 5/2006 |
| JP | 2006-212746 | A | 8/2006 |
| JP | 2007-187049 | A | 7/2007 |
| JP | 2007-228684 | A | 9/2007 |
| JP | 2008-190444 | A | 8/2008 |
| JP | 2009-097358 | A | 5/2009 |
| JP | 2009-097417 | A | 5/2009 |
| JP | 2009-162078 | A | 7/2009 |
| JP | 2009-243363 | A | 10/2009 |
| JP | 2009-293589 | A | 12/2009 |
| JP | 2011-047343 | A | 3/2011 |

OTHER PUBLICATIONS

Office Action dated Oct. 7, 2014, issued in Japanese Patent Application No. 2011-067051 with English Machine Translation (7 pages).
Office Action dated Oct. 7, 2014, issued in Japanese Patent Application No. 2011-071324 with English Machine Translation (7 pages).
Office Action dated Oct. 7, 2014, issued in Japanese Patent Application No. 2011-071495 with English Machine Translation (6 pages).
International Search Report issued in PCT/JP2011/079463, mailing date of Mar. 19, 2012, w/English translation.
International Search Report issued in PCT/JP2011/079464, mailing date of Mar. 19, 2012 w/English translation.
International Search Report issued in PCT/JP2011/079465, mailing date of Mar. 19, 2012 w/English translation.
International Search Report issued in PCT/JP2011/079466, mailing date of Mar. 19, 2012 w/English translation.
International Search Report issued in PCT/JP2011/079467, mailing date of Mar. 19, 2012 w/English translation.
International Search Report issued in PCT/JP2011/079468, mailing date of Mar. 19, 2012 w/English translation.
Office Action dated Apr. 27, 2015 issued in counterpart Chinese application No. 201180069296.7, with English translation. (20 pages).
Office Action dated Apr. 28, 2015 issued in counterpart Chinese application No. 2011800694407, with English translation. (18 pages).
Office Action dated May 6, 2015 issued in counterpart Chinese application No. 201180069287.8 , with English translation. (27 pages).
Office Action dated May 26, 2015 issued in counterpart Chinese application No. 201180069545.2 , with English translation. (14 pages).
Office Action dated May 28, 2015 issued in counterpart Chinese application No. 201180069472.7, with English translation. (18 pages).
International Search Report for PCT/JP2011/079469, Mailing Date of Mar. 19, 2012.

* cited by examiner

SCROLL COMPRESSION DEVICE

TECHNICAL FIELD

The present invention relates to a scroll compression device that supplies lubrication oil to an engagement portion between a fixed scroll and a swing scroll and performs compression through the engagement, between the fixed scroll and the swing scroll.

BACKGROUND ART

There has been hitherto known a scroll compression device that has a compression mechanism comprising a fixed scroll and a swing scroll having mutually engageable spiral laps in a hermetically sealed casing and in which the compress ion mechanism is driven by a driving motor so that the swing scroll makes a circular motion with respect to the fixed scroll without rotating on its own axis, thereby performing compression (see Patent Document 1, for example).

In this type of scroll compression device, low-pressure refrigerant sucked from a suction pipe is compressed in a compression mechanism, and compressed high-pressure refrigerant is discharged to the outside of a casing from a discharge pipe provided to the casing. Lubrication oil is supplied to lubrication sites such as respective sliding portions of the compression mechanism, the engagement portion between the fixed scroll and the swing scroll, etc. The lubrication oil to be supplied is pooled in an oil pool provided at the lower portion of the casing, and lubrication oil which becomes surplus at the lubrication sites is returned to the oil pool by its own weight. Furthermore, the swing scroll is inserted and fitted in an eccentric shaft portion provided eccentrically from the axial center of the driving shaft of the driving motor. Therefore, an upper balancer which opposes the centrifugal force caused by the circular motion of the swing scroll is generally provided to the driving shaft at the upper side of the driving motor.

PRIOR ART DOCUMENT

Patent Document

Patent Document 1: JP-A-2004-60532

SUMMARY OF THE INVENTION

Problem to be Solved by the Invention

However, lubrication oil leaking from each lubrication site is scattered in the outer peripheral direction of the casing to a discharge pipe side provided at the outside of the casing in connection with the rotation of the driving shaft and the upper balancer. There is a problem that a large amount of lubrication oil is discharged from the discharge pipe to the outside of the casing When the lubrication oil scatters to the discharge pipe side.

The present invention has an object to provide a scroll compression device that solves the problem of the prior art described above and prevents scattering of lubrication oil to the discharge pipe side.

Means of Solving the Problem

In order to attain the above object, the present invention is characterized in that a scroll compression mechanism for compressing refrigerant and a driving motor that is connected to the scroll compression mechanism through a driving shaft, and drives the scroll compression mechanism are accommodated in a casing, the scroll compression mechanism is supported in the casing by a main frame, a stator of the driving motor is directly or indirectly supported in the casing, the driving shaft is connected to a rotor of the driving motor and supported in the casing by a bearing plate, a cup that is opened at the lower portion thereof and prevents scattering of lubrication oil is disposed on a lower surface of the main frame, an annular insulator having a double wall structure that surrounds stator coils is disposed on an upper surface of the stator, and a peripheral wall of the cup is hung between double walls of the insulator.

According to the present invention, scattering of lubrication oil can be prevented by the cup, and the lubrication oil scattering to the peripheral side of the cup passes along the peripheral wall of the cup and drops into the gap between the double wails of the insulator. Accordingly, lubrication oil can be prevented from scattering to the discharge pipe side.

In this construction, the peripheral wall of the cup may be hung to be displaced inwardly with respect to the center between the double walls of the insulator. Furthermore, the outer side wall of the double walls of the insulator may be formed to be higher than the inner side wall. The upper end of the outer side wall of the double walls of the insulator may extend to a neighborhood of the lower end of the cup in height. A cutout through which lead wires for the stator coils are drawn out may foe provided to the outer side wall of the double walls of the insulator. The driving motor is a DC driving motor driven by an inverter.

Effect of the Invention

According to the present invention, the cup which is opened at the lower portion thereof and prevents scattering of lubrication oil is disposed on the lower surface of the main frame, the annular insulator having the double wall structure which surrounds the windings is disposed on the upper surface of the stator, and the peripheral wall of the cup is hung between the double walls of the insulator. Therefore, the lubrication oil which scatters to the peripheral wall side of the cup passes along the peripheral wall of the cup and drops to the gap between the double walls of the insulator. Therefore, the lubrication oil can be prevented from scattering to the discharge pipe side.

BRIEF DESCRIPTION OF THE INVENTION

MODE FOR CARRYING OUT THE INVENTION

An embodiment according to the present invention will be described with reference to the drawings.

Figure 1:
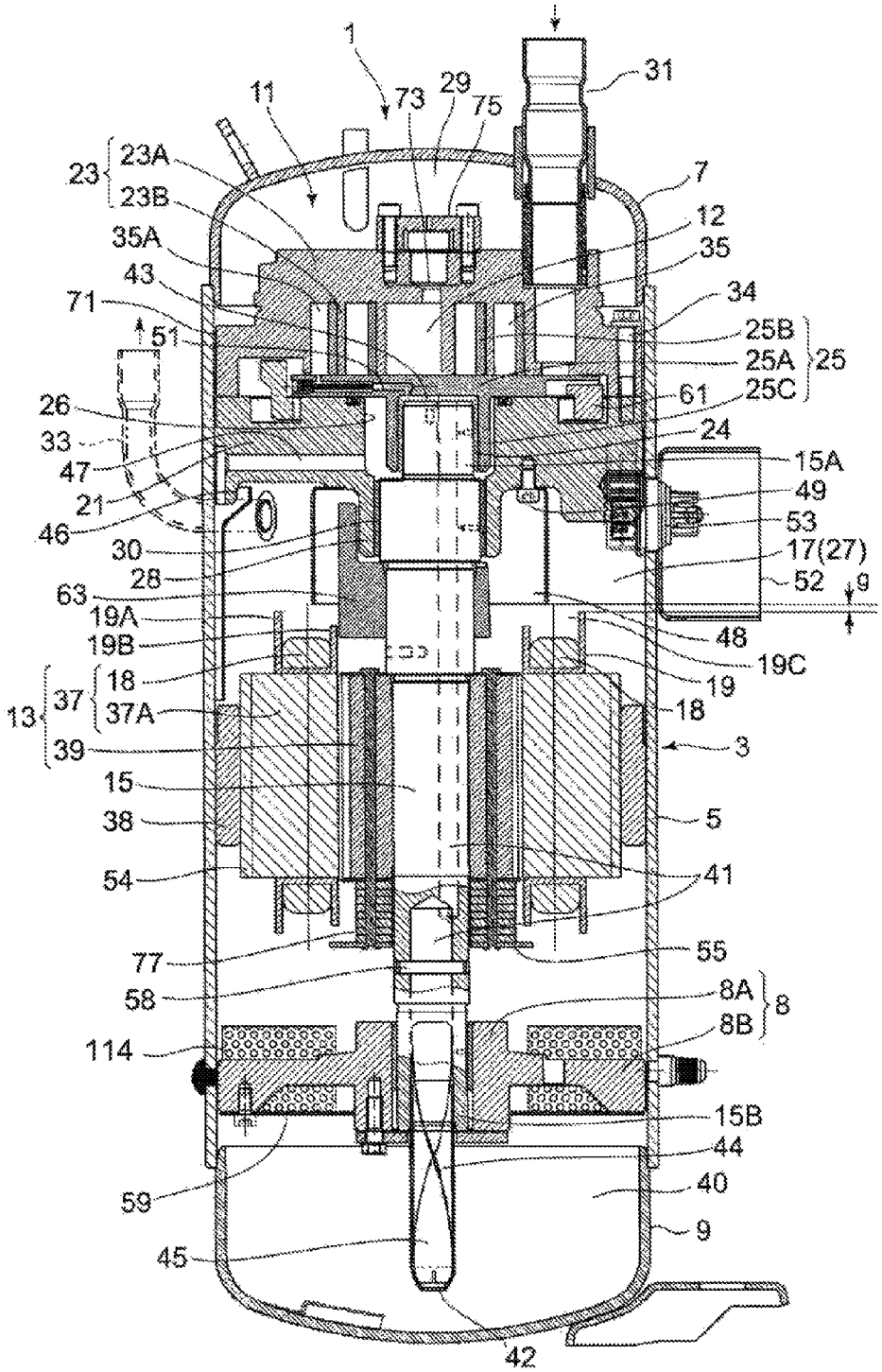
FIG. 1 is a cross-sectional view showing a scroll compression device according to an embodiment of the present invention.

In FIG. 1, reference numeral 1 represents a scroll compression device whose internal pressure is high. The compression device 1 is connected to a refrigerant circuit (not shown) in which refrigerant is circulated to perform a refrigeration cycle operation, and compresses the refrigerant. The compressor 1 has a hermetically-sealed doom type casing 3 having a vertically elongated cylindrical shape.

The casing 3 is configured as a pressure container comprising a casing main body 5 as a cylindrical barrel portion having an axial line extending in the up-and-down direction, a cup-shaped upper cap 7 which is air-tightly welded and integrally joined to the upper end portion of the casing main body 5 and has a convex surface protruding upwards, and a cup-shaped lower cap 9 which is air-tightly welded and integrally joined to the lower end portion of the casing main body 5 and has a convex surface protruding downwards. The inside of the casing 3 is hollow. A terminal cover 52 is provided to the outer peripheral surface of the casing 3, and a power supply terminal 53 for supplying power to a stator 37 described later is provided in the terminal cover 52.

In the casing 3 are accommodated a scroll compression mechanism 11 for compressing refrigerant and a driving motor 13 disposed below the scroll compression mechanism 11. The scroll compression mechanism 11 and the driving motor 13 are connected to each other through a driving shaft 15 which is disposed so as to extend in the up-and-down direction in the casing 3. A gap space 17 is formed between the scroll compression mechanism 11 and the driving motor 13.

A main frame 21 is accommodated at the inner upper portion of the casing 3, and a radial bearing portion 28 and a boss mount portion 26 are formed at the center of the main frame 21. The radial bearing portion 28 pivotally supports the tip (upper end) side of the driving shaft 15, and is configured to project downwards from the center of one surface (lower side surface) of the main frame 21. The boss mount portion 26 is used to accommodate therein a boss 25C of a swing scroll 25 described later, and formed by concaving the center of the other surface (upper side surface) of the main frame 21 downwards. An eccentric shaft portion 15A is formed at the tip (upper end) of the driving shaft 15. The eccentric shaft portion 15A is provided so that the center thereof is eccentric from the shaft center of the driving shaft 15, and inserted through a slewing bearing in the boss 25C so as to be turnably driven.

The scroll compression mechanism 11 comprises a fixed scroll 23 and a swing scroll 25. The fixed scroll 23 is disposed in close contact with the upper surface of the main frame 21. The main frame 21 is secured to the inner surface of the casing main body 5, and the fixed scroll 23 is fixed to the main frame 21. The swing scroll 25 is engaged with the fixed scroll 23, and disposed in a swing space 12 formed between the fixed scroll 23 and the main frame 21. The inside of the casing 3 is partitioned into a high-pressure space 27 below the main frame 21 and a discharge space 29 above the main frame 21. The respective spaces 27 and 29 intercommunicate with each other through vertical grooves 71 which are formed on the outer peripheries of the main frame 21 and the fixed scroll 23 so as to extend vertically.

An intake pipe 31 for introducing the refrigerant in the refrigerant circuit to the scroll compression mechanism 11 air-tightly and fixedly penetrates through the upper cap 7 of the casing 3, and a discharge pipe 33 for discharging the refrigerant in the casing 3 to the outside of the casing 3 air-tightly and fixedly penetrates through the casing main body 5. The intake pipe 31 extends in the up-and-down direction in the discharge space 29, and the inner end portion thereof penetrates through the fixed scroll 23 of the scroll compression mechanism 11 and intercommunicates with the compression chamber 35, whereby the refrigerant is sucked into the compression chamber 35 through the intake pipe 31.

The driving motor (DC driving motor) 13 is a DC (Direct Current) motor which is actuated upon an input from a DC power source, and has an annular stator 37 and a rotor 39 which is freely rot at ably provided in the stator 37. The driving motor 13 is operated while the rotation torque thereof is controlled by a PWM (Pulse Width Modulation) inverter which receives a constant input voltage and controls the duty ratio of pulse waves, that is, an output period of the pulse waves and the pulse width of the output pulse waves. In this embodiment, the driving motor 13 is configured as a DC motor, but the driving motor 13 may be configured as a AC (Alternating Current) motor which is driven with input of AC current.

The swing scroll 25 of the scroll compression mechanism 11 is operationally connected to the rotor 39 through the driving shaft 15. The stator 37 comprises a stator core 31A and a stator coil 18. The stator core 37A is formed by laminating thin iron plates and has plural grooves (not shown) therein. The stator coil 18 is formed by winding stator windings of plural phases, and provided to be fitted in the grooves formed in the stator core 37A and project to the upper and lower sides of the stator core 37A. Each stator coil 18 is accommodated in an insulator 19 at the upper and lower sides of the stator core 37A. The stators 18 are connected to a power supply terminal 53 through lead wires 20 (see FIG. 2) for connecting the respective stator coils 18. The driving motor 13 rotates the rotor 39 by switching the stator coils 18 through which current is passed.

The rotor 39 is magnetized by ferrite magnet or neodymium magnet. As a method of magnetizing the rotor 39 is known a winding magnetizing method of inserting the rotor 39 in the stator 37 and then passing current through stator windings forming the stator coil 18 of the stator 37 to magnetize the rotor 39, or an externally magnetizing method of magnetizing the rotor 39 by using an external magnetizing device and then inserting the rotor 39 in the stator 37. A holder (pin holder) 58 is press-fitted in the driving shaft 15, and used to position the rotor 39 when the winding magnetization of the rotor 39 is performed.

The stator 37 is supported on the inner wall of the casing 3 by an annular spacer ring 38. The spacer ring 38 is fixed to the inner wall surface of the casing 3 by shrinkage fitting, and the stator 37 is fixed to the inner wall surface of the spacer ring 38 by shrinkage fitting. The upper end surface of the spacer ring 38 is provided at a lower position than the upper end surface of the stator 37.

A bearing plate 3 in which the lower end portion of the driving shaft 15 is rotatably fitted and supported is provided below the driving motor 13. The bearing plate 8 has a boss portion 8A into which the cylindrical driving shaft 15 is fitted, and arm portions 8B which are provided at substantially equal intervals on the periphery of the boss portion 8A so as to extend in the four directions and fixed to the casing main body 5. That is, the driving shaft 15 is supported in the casing 3 by the bearing plate 8. The bearing plate 8 has an opening portion 8E which is formed among the respective arm portions 8B and through which upper and lower spaces above and below the bearing plate 8 intercommunicate with each other.

As shown in FIG. 1, the lower space (oil pool) 40 below the bearing plate 8 is kept at high pressure, and oil is pooled at the inner bottom portion of the lower cap 9 corresponding to the lower end portion of the lower space 40. An annular plate 59 is provided between the bearing plate 8 and the oil pool 40 so as to be fixed to the bearing plate 8. Furthermore, a baffle plate 114 is provided above the annular plate 59 so as to be supported by the annular plate 59. The baffle plate 114 is formed of thin plate type punching metal having many fine pores, for example.

A oil supply path 41 as a part of high-pressure oil supplying means is formed in the driving shaft 15, and the oil supply path 41 extends vertically in the driving shaft 15 and intercommunicates with an oil chamber 43 at the back side of the swing scroll 25. The oil supply path 41 is connected to an oil pickup 45 provided to the lower end of the driving shaft 15. A lateral hole 57 is provided at the back side of the oil pickup 45 so as to extend in the radial direction of the driving shaft 15 and penetrates through the oil supply path 41. The holder 58 described above is press-fitted into the lateral hole 57. The oil pickup 45 is press-fitted into the driving shaft 15 after the rotor 39 is magnetized, The oil pickup 45 has a suction port 42 provided to the lower end thereof, and a paddle 44 formed above the suction port 42. The lower end of the oil pickup 45 is immersed in lubrication oil (lubrication oil) pooled in the oil pool 40, and the suction port 42 of the oil supply path 41 is opened in the lubrication oil. When the driving shaft 15 rotates, the lubrication oil pooled in the oil pool 40 enters the oil supply path 41 from the suction port 42 of the oil pickup 45, and is pumped up along the paddle 44 of the oil supply path 41. The thus-pumped lubrication oil is passed through the oil supply path 41, and supplied to the respective sliding portions of the scroll compression mechanism 11 such as the radial bearing portion 28, the slewing bearing 24, etc. Furthermore, the lubrication oil is supplied through the oil supply path 41 to the oil chamber 43 at the back side of the swing scroll 25, and supplied from the oil chamber 43 through an intercommunication path 51 provided to the swing scroll 25 to the compression chamber 35.

The main frame 21 penetrates radially from the boss mount portion 26 through the main frame 21 to form a return oil path 47 opened to the vertical groove 71. Excessive lubrication oil out of the lubrication oil supplied through the oil supply path 41 to the respective sliding port ions of the scroll compression mechanism 11 and the compression chamber 35 is passed through the return oil path 47 and returned to the oil pool 40. An oil collector 46 is provided below the return oil path 47, and the oil collector 46 extends to the neighborhood of the upper end of the spacer ring 38. Plural notches 54 are formed on the outer peripheral surface of the stator 37 so as to extend between the upper and lower sides of the stator 37. The lubrication oil returned from the oil supply path 41 through the return oil path 47 and the oil collector 46 is passed through the gap between the notches 54 and the gap between the respective arm portions 8B and returned to the oil pool 40. In the cross-sectional view of FIG. 1, the discharge pipe 33 is represented by broken lines for the purpose of simplification of description, but the discharge pipe 33 is disposed to be displaced in phase from the oil collector 46.

The fixed scroll 23 comprises an end plate 23A and a spiral (involute type) lap 23B formed on the lower surface of the end plate 23A. The swing scroll 25 comprises an end plate 25A and a spiral (involute type) lap 23B formed on the upper surface of the end plate 25A. The lap 23B of the fixed scroll 23 and the lap 25B of the swing scroll 25 are engaged with each other, whereby plural compression chambers 35 are formed between the fixed scroll 23 and the swing scroll 25 by both the laps 23B, 25B.

The swing scroll 25 is supported by the fixed scroll 23 through an Oldham's ring 61, and a cylindrical boss 25C having a bottom is provided to the center portion of the lower surface of the end plate 25A so as to protrude from the center portion. Furthermore, the eccentric shaft portion 15A is provided to the upper end of the driving shaft 15, and the eccentric shaft portion 15A is rotatably fitted in the swing scroll 25.

Furthermore, a counter weight portion (upper balancer) 63 is provided to the driving shaft 15 below the main frame 21, and a lower balancer 77 is provided to the lower portion of the rotor 39. The driving shaft 15 keeps dynamic balance with the swing scroll 25, the eccentric shaft portion 15A, etc. by the upper balancer 63 and the lower balancer 77.

The driving shaft 15 rotates with keeping weight balance by the counter weight portion 63 and the lower balancer 77, whereby the swing scroll is made to make an orbital motion. In connection with the orbital motion of the swing scroll 25, the compression chamber 35 is configured to compress refrigerant sucked through the suction pipe 31 by contraction of the volume between both the laps 23B, 25B to the center. A regulation plate 55 which is swaged integrally with the rotor 39 and the lower balancer 77 is provided to the lower surface of the lower balancer 77. The regulation plate 55 will be described in detail later, and is used to regulate the rotation of the rotor 39 when the winding magnetization of the rotor 39 is performed.

A cup 48 is fixed to the lower side of the main frame 21 by a bolt 49 so as to surround the periphery of the counterweight portion 63. The cup 48 prevents the lubrication oil leaking from the clearance between the main frame 21 and the driving shaft 15 from scattering to the discharge pipe side due to rotation of the counterweight portion 63.

A discharge hole 73 is provided to the center portion of the fixed scroll 23, and gas refrigerant discharging from the discharge hole 73 passes through a discharge valve 75, discharges to the discharge space 29, and then flows out through the vertical grooves 71 provided on the outer peripheries of the main frame 21 and the fixed scroll 23 to the high-pressure space 27 below the main frame 21. This high-pressure refrigerant is discharged to the outside of the casing 3 through the discharge pipe 33 provided to the casing main body 5.

The driving operation of the scroll compression device 1 will be described.

When the driving motor 13 is actuated, the rotor 39 rotates with respect to the stator 37, whereby the driving shaft 15 rotates. When the driving shaft 15 rotates, the swing scroll 25 of the scroll compression mechanism 11 makes only an orbital motion around the fixed scroll 23 without making autorotation. Accordingly, low-pressure refrigerant, is passed through the suction pipe 31 and sucked from the peripheral edge side of the compression chamber 35 into the compression chamber 35. This refrigerant is compressed due to the volumetric change of the compression chamber 35, and this compressed refrigerant becomes high-pressure and is discharged from the compression chamber 35 through the discharge valve 75 to the discharge space 29, and then flows out through the vertical grooves 71 provided on the respective outer peripheries of the main frame 21 and the fixed scroll 23 to the high-pressure space 27 below the main frame 21. This high-pressure refrigerant is discharged to the outside of the casing 3 through the discharge pipe 33 provided to the casing main body 5. The refrigerant discharged to the outside of the casing 3 is circulated in the refrigerant circuit (not shown), sucked through the suction pipe 31 into the compressor and compressed again. The circulation of the refrigerant described above is repeated.

The flow of the lubrication oil will be described. The lubrication oil pooled at the inner bottom portion of the lower cap 9 in the casing 3 is scraped up by the oil pickup 45, passed through the oil supply path 41 of the driving shaft 15 and supplied to the respective sliding portions of the scroll compression mechanism 11 and the compression chamber 35. The excessive lubrication oil at the respective sliding portions of the scroll compression mechanism 11 and the compression chamber 35 is collected from the return oil path 47 to the oil collector 46, passed through the notches 54 provided to the outer periphery of the stator 37 and returned to the lower side of the driving motor 13.

The lubrication oil which is passed through the oil supply path 41 and supplied to the radial bearing 30 leads out from the lower end of the radial bearing portion 28, and scatters to the outer peripheral wall (peripheral wall) 48A side of the cup 48 due to the rotation of the driving shaft 15 and the upper balancer 63. The cup 48 is opened at the lower portion (lower end) 48B thereof. An insulator 19 is provided to the upper surface of the stator 37 so as to surround the stator coils 13, and the insulator 19 is configured in a double wall structure having annular outer side wall 19A and inner side wall 19B. The outer peripheral wall 48A of the cup 48 is hung so as to be located between the outer and inner side walls 19A and 19B of the insulator 19 having the double wall structure and also be displaced inwardly with respect to the center C between the outer and inner side walls 19A and 19B, that is, nearer to the inner side wall 19B side. The outer peripheral wall 43 of the cup 48 and each of the outer and inner side walls 19A and 19B of the insulator 19 are located away from each other at a predetermined insulation distance or more.

According to this construction, the lubrication oil which leaks out from the lower end of the radial bearing portion 28 and scatters to the outer peripheral wall 48A side of the cup 48 due to the rotation of the driving shaft 15 and the upper balancer 63 passes along the outer peripheral wall 48A to the gap between the outer and inner side walls 19A and 19B of the insulator 19. Accordingly, the lubrication oil scattered due to the rotation of the driving shaft 15 and the upper balancer 63 can be prevented from scattering to the discharge pipe 33 provided to the outer periphery of the casing 3, and thus a large amount of lubrication oil leaking from the lower end of the radial bearing portion 28 can be prevented from being discharged to the outside of the casing 3.

The outer side wall 19A of the insulator 19 is formed to be higher than the inner side wall 13B, and the outer side wall ISA is formed at such a height that the upper end 19C thereof extends to a neighborhood of the lower end 48A of the cup 48. The height of the outer side wall 19A of the insulator 19 is set so that a gap g is provided between the upper end 19C and the lower end 48A of the cup 48, and the upper end 19C is located to be slightly lower than the lower end 48A.

According to this construction, the lubrication oil which leaks out from the lower end of the radial bearing portion 28 and scatters to the outer peripheral wall 48A side of the cup 48 due to the rotation of the driving shaft 15 and the upper-balancer 63 passes along the outer peripheral wall 48A and drops to the gap between the outer and inner side walls 19A and 19B of the insulator 19. At this time, even when the lubrication oil scatters obliquely downwardly from the cup 48 due to the rotation of the driving shaft 15 and the upper balancer 63, the lubrication oil drops to the inside of the outer side wall 19A of the insulator 19. Accordingly, the lubrication oil can be prevented from being scattered to the discharge pipe 33 provided to the outer periphery of the casing 3, and a large amount of lubrication oil can be prevented from being discharged from the discharge pipe 33 to the outside of the casing 3.

Figure 2:
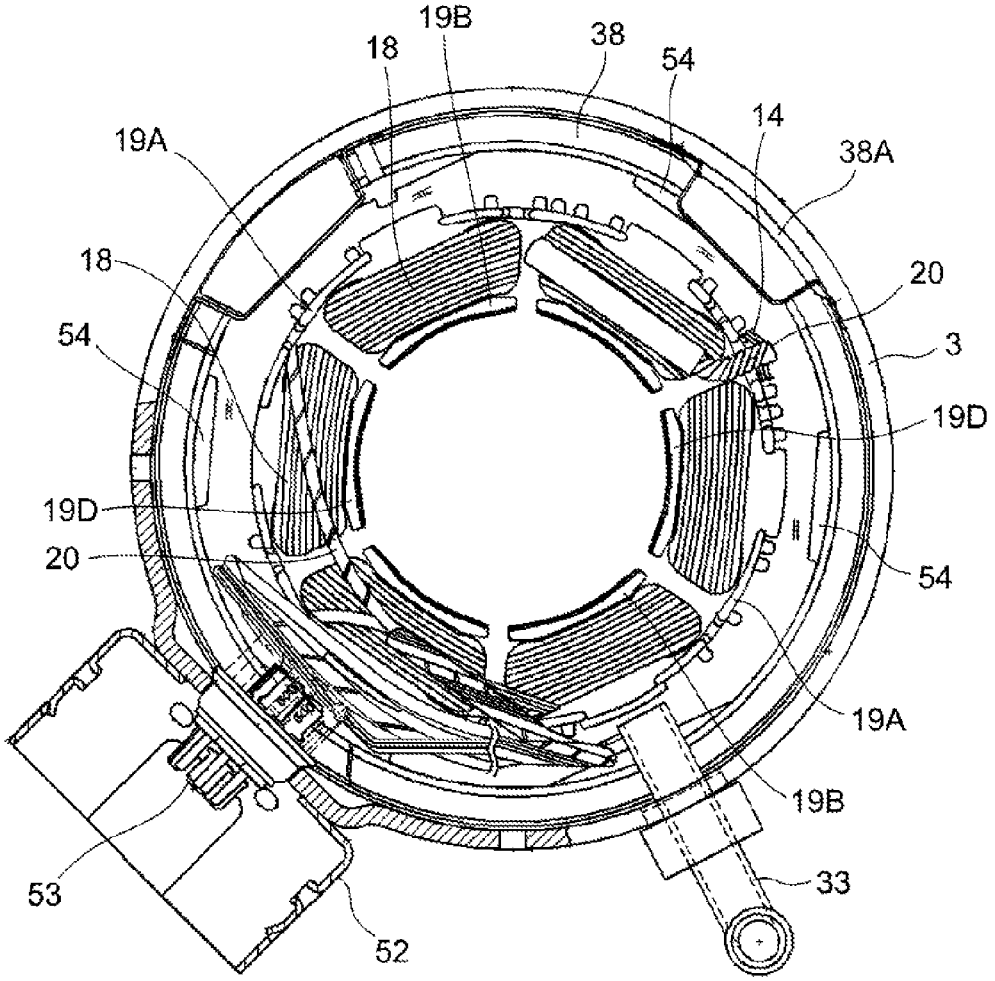
FIG. 2 is a plane cross-sectional view of the scroll compression device.

FIG. 2 is a plan cross-sectional view of the scroll compression device when the scroll compression device is cross-sectioned at the upper side of the driving motor 13. In FIG. 2, the driving shaft 15 and the rotor 39 are not shown. As shown in FIG. 2, the lead wires 20 extending from the stator coils 18 are passed through the upper side of the upper end 19C of the insulator 19 and connected to the power supply terminal 53. the respective stator coils 18 provided to the upper surface of the stator 37 are accommodated between the outer and inner side walls 19A and 19B of the insulator 19 having the double wall structure.

The stator 37 are provided with notches 54 through which the upper and lower spaces of the driving motor 13 intercommunicate with each other. Plural cutouts 38A are formed on the spacer-ring 38 so as to extend between the upper and lower sides of the spacer ring 38. The lubrication oil is passed from the upper side of the driving motor 13 through the notches 54 and the notches 38 and returned to the lower side of the driving motor 13.

The inner side wall 19B comprises plural walls 19D provided at the inside of the respective stator coils 18, and a predetermined separation interval is provided between the respective adjacent walls 19D. The lubrication oil dropping into the gap between the outer side wall 19B and the inner side wall 19B of the insulator 19 may be discharged to the lower side of the stator 37 from the respective intervals between the respective walls constituting the inner side wall 19B.

Figure 3:
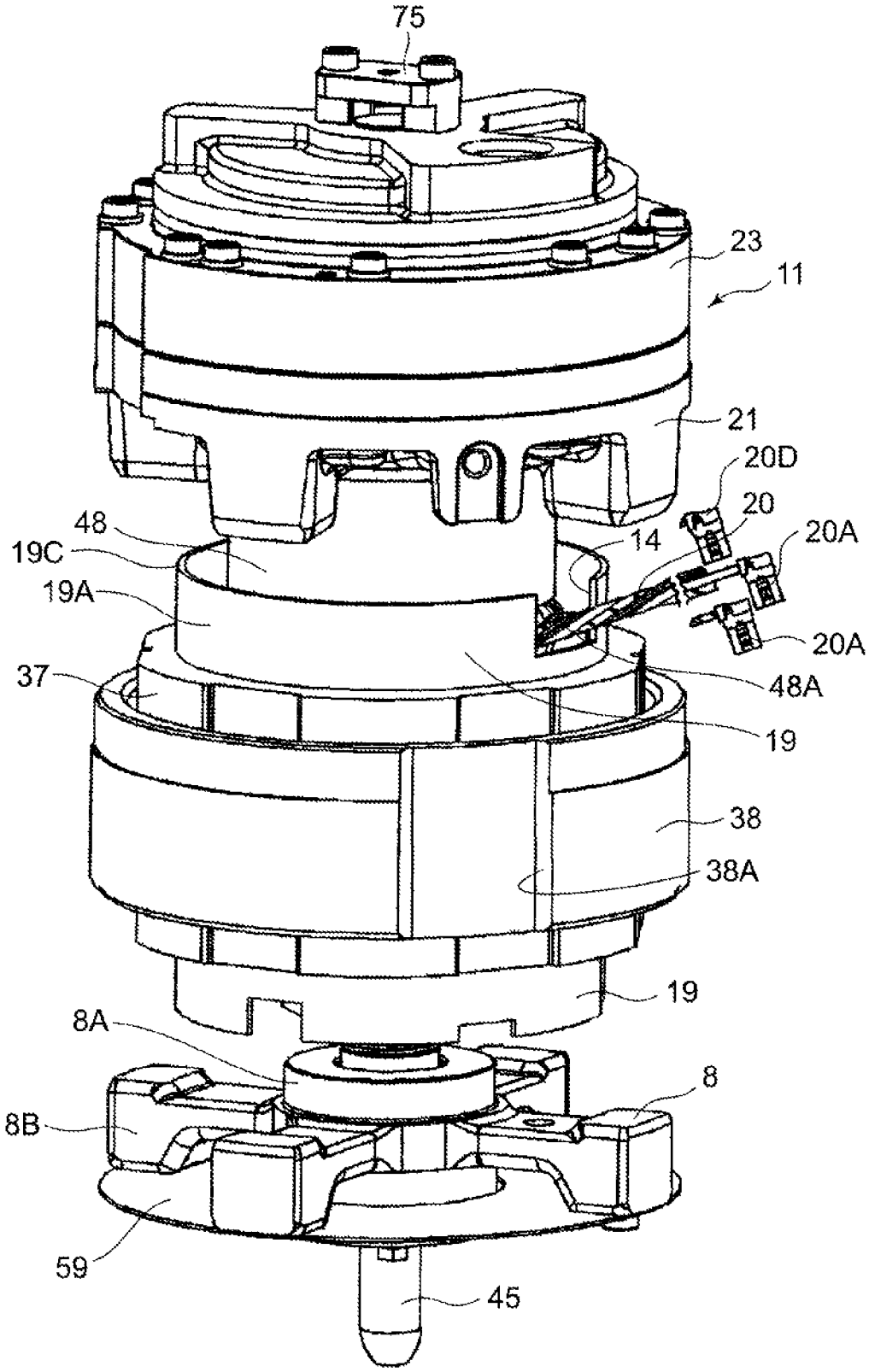
FIG. 3 is a diagram showing the internal construction of the scroll compression device according to a modification.

FIG. 3 is a diagram showing a modification of the scroll 1 shown in FIG. 1.

In the scroll compression device described above, the height of the outer side wall 19A of the insulator 19 is set so that the upper end 19C is located to be slightly lower than the lower end 48A of the cup 48, and the lead wires 20 are connected to the power supply terminal 53 through the upper side of the upper end 19C of the outer side wall 19A. In the modification shown in FIG. 3, the height of the outer side wall 19A of the insulator 19 is set so that the upper end 19C is located to be higher than the lower end 48A of the cup 48. Furthermore, a cutout 14 through which the lead wires 20 extending from the stator coils 18 are drawn out to the outside of the insulator 19 is formed in the outer side wall 19A of the insulator 19. As shown in FIG. 3, the cutout 14 is formed by cutting out a part of the outer side wall 19A from the upper portion thereof. The lead wires 20 drawn out through the cut-out 14 to the outside of the insulator 19 are connected to the power supply terminal 53 by using connection terminals 20A. The cut-out 14 is provided in the neighborhood of the cutout 38A formed so as to extend between the upper and lower sides of the spacer ring 33. The cutout 14 is provided away from the discharge pipe 33 in the peripheral direction.

According to this construction, the lubrication oil which leaks out from the lower end of the radial bearing portion 28 and scatters to the outer peripheral wall 48A side of the cup 48 due to the rotation of the driving shaft 15 and the upper balancer 63 is enabled to surely drop into the gap between the outer and inner side walls 19A and 19B of the insulator 10, and the lubrication oil can be prevented from scattering to the discharge pipe 33 provided to the outer periphery of the casing 3. Accordingly, a large amount of lubrication oil can be prevented from being discharged from the discharge pipe 33 to the outside of the casing 3.

Furthermore, according to this construction, even when the height of the outer side wall 19A is set so that the upper end 19C of the outer side wall 19A of the insulator 19 is located at the upper side of the lower end 48A of the cup 48, the lead wires 20 can be drawn out from the cutout 14 provided to the outer side wall 19A to the outside of the insulator 19. Therefore, the insulation distance between each of the lead wires 20 and the cup 48 can be kept.

As described above, according to the embodiment to which the present invention is applied, the scroll compression mechanism 11 for compressing refrigerant and the driving motor 13 that is connected to the scroll compression mechanism 11 through the driving shaft 15 and drives the scroll compression mechanism 11 are accommodated in the casing 3, the scroll compression mechanism 11 is supported in the casing 3 by the main frame 21, the stator 37 of the driving motor 13 is directly or indirectly supported in the casing 3, the driving shaft 15 is connected to the rotor 39 of the driving motor 13, the driving shaft 15 is supported in the casing 3 by the bearing plate 8, the cup 48 which is used to prevent scattering of lubrication oil and opened at the lower portion thereof is disposed on the lower-surface of the main frame 21, the insulator 19 having the annular double wall structure which surrounds the windings is disposed on the upper surface of the stator 37, and the peripheral wall 48A of the cup 48 is hung between the double walls ISA and 19B of the insulator. Therefore, the lubrication oil which leaks out from each lubrication site and scatters due to rotation of the driving shaft 15 can be collected. The lubrication oil collected in the cup 48 passes along the outer peripheral wall 48A of the cup 48 and drops into the gap between the double walls 19A and 19B of the insulator. Therefore, the lubrication oil can be prevented from scattering to the discharge pipe 33 disposed at the outside of the casing 3, and thus a large amount of lubrication oil can be prevented from being discharged from the discharge pipe 33.

Furthermore, according to this embodiment, the peripheral wall 48A of the cup 18 is hung to be displaced inwardly from the center between the double walls 19A and 19B of the insulator 19. Therefore, even when the lubrication oil which is passed along the outer peripheral wall 48A of the cup 48 and guided to the lower side of the cup 48 scatters obliquely downwardly from the opened lower portion of the cup 48, the lubrication oil is allowed to drop to the inside of the outer side wall 19A of the insulator 19, and can be prevented from scattering to the discharge pipe 33 disposed at the outside of the casing 3, so that a large amount of lubrication oil can be prevented from being discharged from the discharge pipe 33.

Still furthermore, according to the embodiment, to which the present invention is applied, the outer side wall 19A of the double walls of the insulator 19 is formed to be higher than the inner side wall 19B. Therefore, the lubrication oil which scatters obliquely downwardly from the lower opening portion of the cup 48 due to the rotation of the driving shaft 15 is enabled to more effectively drop to the inside of the outer side wall ISA of the insulator 19. Accordingly, the lubrication oil can be prevented from scattering to the discharge pipe 33 disposed at the outside of the casing 3, and a large amount of lubrication oil can be prevented from being discharged from the discharge pipe 33.

Still furthermore, according to the embodiment to which the present invention is applied, the upper end of the double wall of the insulator 19 extends to the neighborhood of the lower end of the cup, so that the lubrication oil which scatters obliquely downwardly from the lower opening of the cup 48 due to the rotation of the driving shaft 15 can be made to more surely drop to the inside of the outer side wall 19A of the insulator 19. Accordingly, the lubrication oil can be prevented from scattering to the discharge pipe 33 disposed at the outside of the casing 3, and a large amount of lubrication oil can be prevented from being discharged from the discharge pipe 33.

Still furthermore, according to the embodiment to which the present invention is applied, the outer side wall 19A of the double walls of the insulator 19 is provided with the cutout 14 through which the lead wires 20 of the windings are drawn out. Therefore, the lead wires 20 can be drawn out from the cutout 14 formed in the outer side wall 19A to the outside of the insulator 19, and the insulation distance between each lead wire 20 and the cup 48 can be kept.

Furthermore, according to the embodiment to which the present invention is applied, the driving motor 13 is a DC driving motor whose rotation torque is controlled by the PWM inverter. Therefore, the driving motor 13 can be miniaturized by using a driving motor having a high output efficiency. Furthermore, occurrence of needless heat caused by increase/decrease of the voltage of the driving motor 13 can be prevented, and the driving efficiency can be increased by driving the DC driving motor with the inverter.

DESCRIPTION OF REFERENCE NUMERALS

1 scroll compression device
3 casing
11 scroll compression mechanism
13 driving motor (DC driving motor)
14 lead wire cutout
19 insulator
19A outer side wall
19B inner side wall
20 lead wire
21 main frame
37 stator
39 rotor
48 cup
48A peripheral wall (outer peripheral wall)

The invention claimed is:

1. A scroll compression device comprising:

a scroll compression mechanism for compressing refrigerant; and a driving motor that is connected to the scroll compression mechanism through a driving shaft and drives the scroll compression mechanism, wherein the scroll compression mechanism and the driving motor are accommodated in a casing;

the scroll compression mechanism is supported in the casing by a main frame;

a stator of the driving motor is directly or indirectly supported in the casing;

the driving shaft is connected to a rotor of the driving motor and supported in the casing by a bearing plate; and a cup that is opened at the lower portion thereof and prevents scattering of lubrication oil is disposed on a lower surface of the main frame, an annular insulator having a double wall structure that surrounds stator coils is disposed on an upper surface of the stator, and a peripheral wall of the cup is hung between an outer side wall of the double walls of the insulator and an inner side wall of the double walls of the insulator.

2. The scroll compression device according to claim 1, wherein the peripheral wall of the cup is hung to be displaced inwardly from the center between the double walls of the insulator.

3. The scroll compression device according to claim 1, wherein the outer side wall of the double walls of the insulator is formed to be higher than the inner side wall of the double walls of the insulator.

4. The scroll compression device according to claim 3, wherein an upper end of the outer side wall of the double walls of the insulator extends to a position next to a lower end of the cup in height.

5. The scroll compression device according to claim 1, wherein a cutout through which lead wires for the stator coils are drawn out is provided to the outer side wall of the double walls of the insulator.

6. The scroll compression device according to claim 2, wherein the outer side wall of the double walls of the insulator is formed to be higher than the inner side wall of the double walls of the insulator.

7. The scroll compression device according to claim 2, wherein a cutout through which lead wires for the stator coils are drawn out is provided to the outer side wall of the double walls of the insulator.

8. The scroll compression device according to claim 3, wherein a cutout through which lead wires for the stator coils are drawn out is provided to the outer side wall of the double walls of the insulator.

9. The scroll compression device according to claim 4, wherein a cutout through which lead wires for the stator coils are drawn out is provided to the outer side wall of the double walls of the insulator.

* * * * *